US006544100B1

(12) United States Patent
Nadsady et al.

(10) Patent No.: US 6,544,100 B1
(45) **Date of Patent: *Apr. 8, 2003**

(54) PUSH-UP BRA PAD

(75) Inventors: Kathleen Nadsady, Ventura, CA (US); Ann Deal, Ventura, CA (US); Chih Jung Lee, Monterey Park, CA (US); Judy Lee, Monterey Park, CA (US)

(73) Assignee: Ce Soir Lingerie Co., Inc., Ventura, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/762,918

(22) PCT Filed: Jun. 14, 1999

(86) PCT No.: PCT/US99/13376

§ 371 (c)(1),
(2), (4) Date: May 29, 2001

(87) PCT Pub. No.: WO00/08960

PCT Pub. Date: Feb. 24, 2000

Related U.S. Application Data

(63) Continuation of application No. 09/132,572, filed on Aug. 11, 1998, now Pat. No. 6,015,332.

(51) Int. Cl.[7] ..... A41C 3/00

(52) U.S. Cl. ..... 450/38; 450/57; 623/7; 623/8

(58) Field of Search ..... 450/38, 37, 57, 450/58, 30–35, 53; 2/267, 268; 623/7, 8; 607/104–108

(56) References Cited

U.S. PATENT DOCUMENTS

| | | | | | |
|---|---|---|---|---|---|
| 3,304,558 | A | * | 2/1967 | Mann | 450/57 |
| 3,845,507 | A | * | 11/1974 | Kirby et al. | 623/7 |
| 4,024,876 | A | * | 5/1977 | Penrock | 623/7 |
| 4,125,117 | A | * | 11/1978 | Lee | 623/7 |
| 4,731,081 | A | * | 3/1988 | Tiffany et al. | 623/8 |
| 4,820,303 | A | * | 4/1989 | Brauman | 623/8 |
| 5,098,330 | A | * | 3/1992 | Greenberg | 450/57 |
| 5,411,554 | A | * | 5/1995 | Scopelianos et al. | 623/8 |
| 6,015,332 | A | * | 1/2000 | Lee et al. | 450/57 |

* cited by examiner

*Primary Examiner*—Gloria M. Hale
(74) *Attorney, Agent, or Firm*—Marvin E. Jacobs

(57) ABSTRACT

A push-up bra has an envelope between the front panel and the rear panel of the bra cups, that receives a flexible pouch containing a mixture of water and a hygroscopic agent such as 70% glycerine-30% water. The hygroscopic agent will draw moisture into the envelope preventing the volume of liquid from decreasing.

10 Claims, 3 Drawing Sheets

PUSH-UP BRA PAD

This application is a continuation of Ser. No. 09/132,572 filed Aug. 11, 1998 now U.S. Pat. No. 6,015,332.

TECHNICAL FIELD

The present invention relates to an improved pad for a brassiere and, more particularly to a flexible, liquid filled envelope incorporated into a push-up bra or into a pad for placement in a conventional bra.

BACKGROUND OF THE INVENTION

Brassieres are worn not only to provide support for women's breasts, but also to enhance the shape of the breasts within the brassieres, the portion of the breasts above the breasts and the cleavage between the breasts.

Push-up bras are designed to shape and elevate the breasts. Push-up bras usually contain a rubber pad received in a pocket in the lower front panels of the bra cups. The pad is formed by molding into a complex arcuate shape. Rubber pads are both stiff and uncomfortable. Rubber pads also caused insecurity due to straying of the pads. Other push-up bras used a more yielding silicone foam and some use Nylon (polyamide) padding to shape and lift.

Push-up bras with liquid filled envelopes have recently appeared on the market. Silicone oil liquids are very expensive and are hard to seal. Hydrocarbon oils have also been utilized as the liquid either alone or in a mixture with water. Hydrocarbons can attack the envelope. The liquids in the envelope are heated to body temperature of about 99° F. At this temperature, evaporation is increased and the hydrocarbon vapors can permeate through the wall of the envelope, creating offensive, unpleasant odors. Furthermore, water vapor is also able to permeate through the wall of the envelope decreasing the liquid volume in the envelope. The envelope could rupture on impact or when pierced by a sharp object causing embarrassment, discomfort and destruction of the pad.

List of References

| Patentee | Patent No. |
|---|---|
| Block, et al. | 3,620,222 |
| Kirby, et al. | 3,845,507 |
| Lynch | 3,986,123 |
| Miller | 5,235,974 |

STATEMENT OF THE PRIOR ART

Block, et al. discloses a foam, push-up brassiere pad. Kirby, et al. discloses a breast prosthesis to be worn inside a brassiere cup containing an inner bag. A gel-like liquid such as carboxymethyl cellulose is sealed within an outer bag containing air. Miller discloses an electrically heated bra for lactating mothers containing a fluid impermeable chamber filled with water.

Lynch discloses a breast prosthesis filled with a low density silicone gel. The gel used by Lynch is not malleable.

STATEMENT OF THE INVENTION

The improved push-up pad according to the invention contains a flexible envelope filled with a mixture of water and an odorless, organic hygroscopic agent in specified proportions providing no unpleasant aroma and little evaporation of water through the film of the envelope. The envelope is formed of a film of a tough synthetic resin resistant to puncture, preferably a thermoplastic resin capable of being heat-sealed. The film has low transmission rate for water vapor. The hygroscopic agent is able to drive water vapor from outside the envelope through the film into the envelope so that liquid volume is maintained. Unlike a prosthesis which has a volume and shape equal to a breast, the push-up pad of the invention has a volume less than that of a breast, usually from 10% to 40% of the volume of a breast.

The push-up pad of the invention when placed in a bra cup looks and feels more natural. The bra pad eliminates discomfort and insecurity caused by stiff, sharp edged or straying inner pads. The inner cup lining adjacent the skin can be a soft fabric that wicks moisture away from the skin.

The pads of the invention can also be used in outerwear such as bathing suit tops and athletic tops.

These and many other features and attendant advantages of the invention will become apparent as the invention becomes better understood by reference to the following detailed description when considered in conjunction with the accompanying drawings.

DETAILED DESCRIPTION OF THE INVENTION

Figure 1:
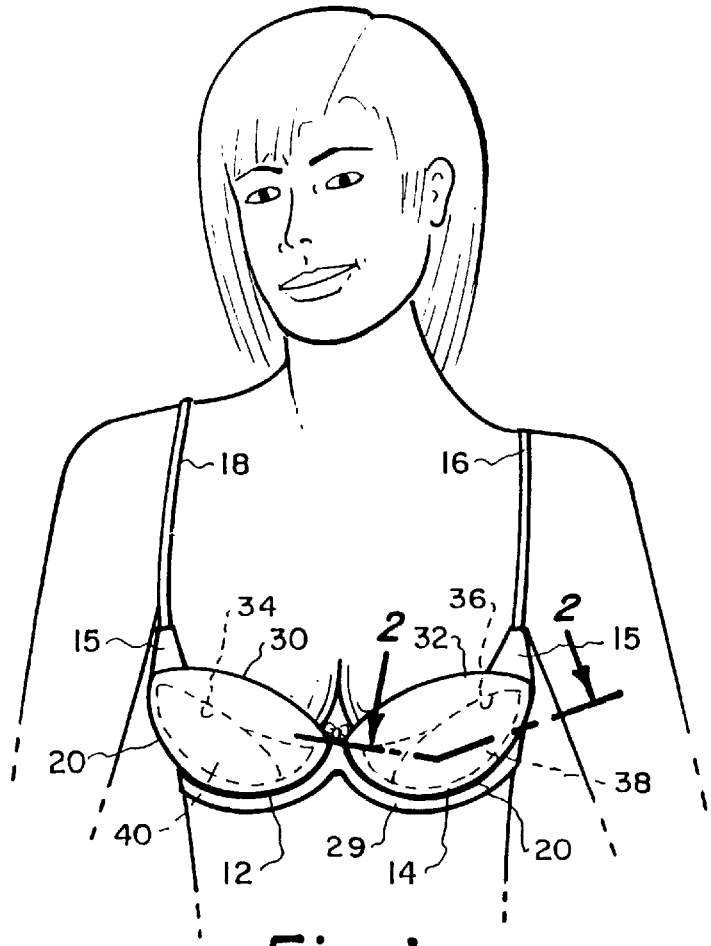
FIG. 1 is front view in elevation illustrating the push-up bra of the invention.
Figure 2:
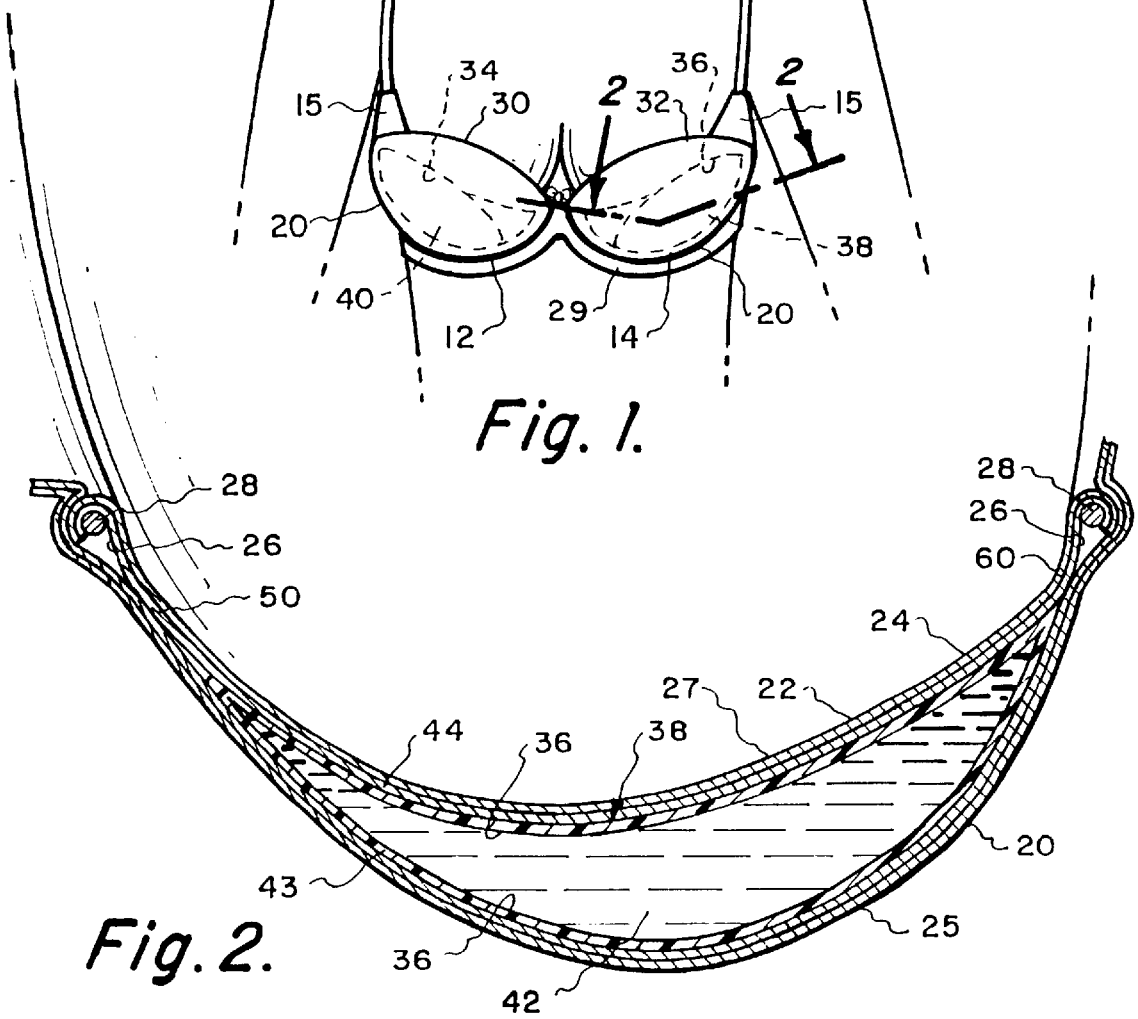
FIG. 2 is a view in section taken along line 2—2 of FIG. 1.
Figure 3:
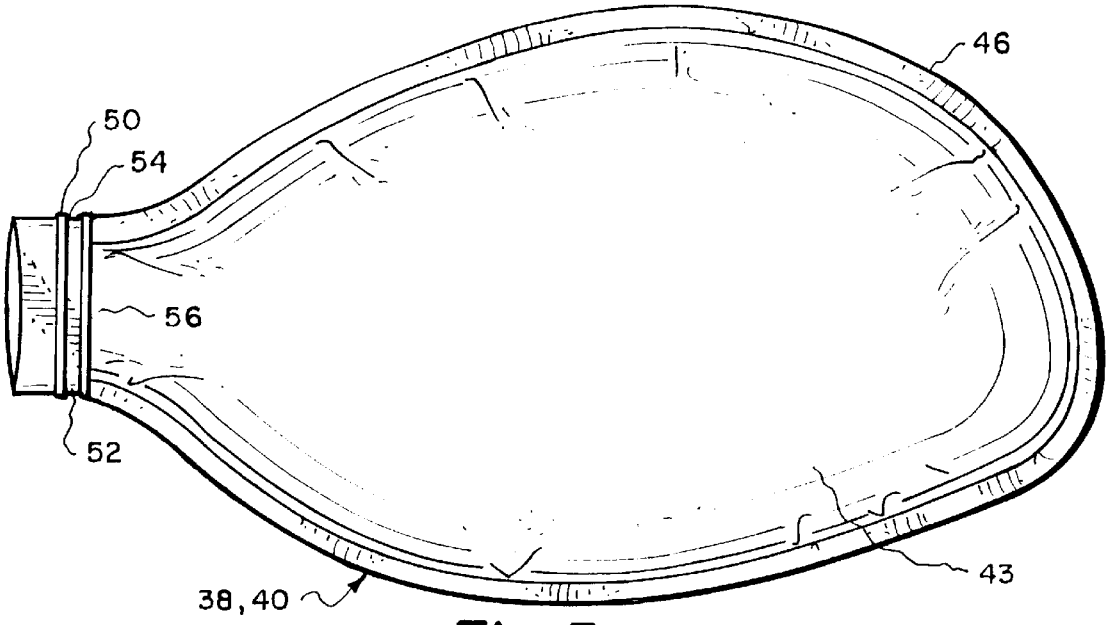
FIG. 3 is a side view in elevation of a bra pad envelope.
Figure 4:
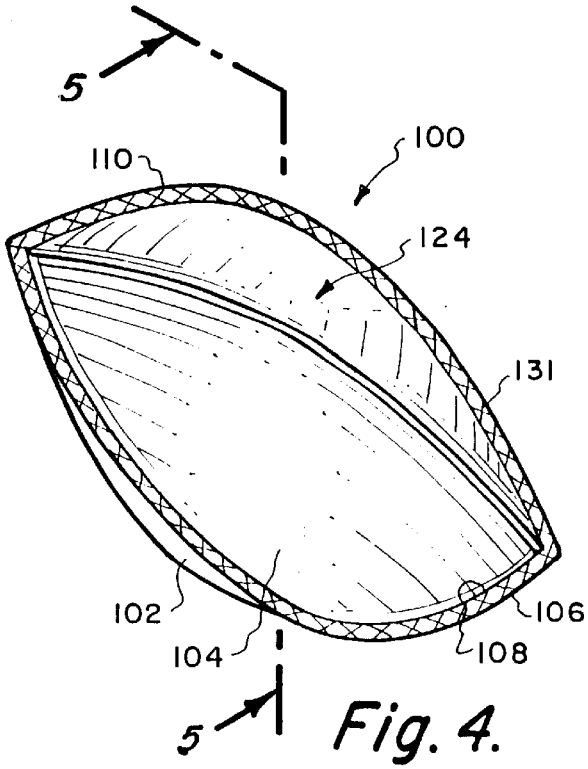
FIG. 4 is a perspective view of a bra pad containing a liquid filled envelope.
Figure 5:
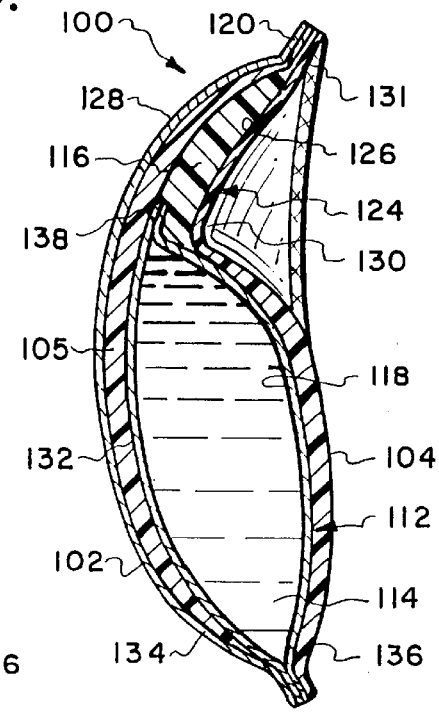
FIG. 5 is a view in section taken along line 5—5 of FIG. 4.

Referring now to FIGS. 1 and 2, a push-up bra 10 useful with the liquid-filled pouch 38 of the invention is formed of two cups 12, 14, a stretchable strap 15 connected to the outside periphery 16, 18 of each cup 12, 14 with releasable fastener, not shown, and optional shoulder straps 16, 18.

The cups 12, 14 are formed of an outer layer 20 of fabric and an inner layer 22 of fabric. The outer layer 20 of fabric can be covered with a layer 25 of decorative material such as lace. The surface 24 of the inner layer 22 is preferably covered with a layer of a soft material 27 which absorbs and wicks moisture such as woven cotton or polypropylene cloth. A long narrow sleeve 26 can be formed which follows the curved outline of the lower periphery 29 of the bra cups 12, 14. A curved metal stiffening rod 28 can be received in the sleeve 20 and inner layers 22 of each cup 12, 14.

The outer layers are stitched around their common peripheries 30, 32 to form pockets 34, 36 for receiving a flexible pouch 38, 40 containing a liquid 42 as shown in FIG. 2. The pouches 38, 40 have the general exterior shape of a bra cup 12, 14. The pouches 38, 40 are formed of a front film 43 heat sealed to a rear panel 44 forming a lip 46. The pouches 38, 40 are liquid tight and have a low permeability for water. The pouches 38, 40 are preferably anchored to the outer layer 20 or inner layer 22 of fabric. The lip 46 could be formed by adhering the outer peripheries of the two panels by adhesive or stitching. However, stitching or adhesive could make the lip 46 more susceptible to tear. It is preferred that the pouches 38, 40 be provided with an extended tab 50 which before thermal bonding serves as a filling spout. The pouches 38, 40 are filled with a body of liquid 42, which occupies no more than 80% of the volume of the pouch, usually 40–60% of the volume.

The two layers 20, 22 of the pouch are completely thermal sealed within the tab 50 into a unitary film 52. Two thermally generated beads 54, 56 can be provided normal to the axis of the pouches to reinforce the tab from tearing.

The tab 50 is sewn 60 into the edge of the outer layer of fabric 20 near the outside periphery of the pockets 34, 36. The pouches 38, 40 are then inserted into the pockets 34, 36. The edge of the inner layer 22 of fabric is then stitched to the edge of the outer layer 20.

The skin of the pouch is a tough, puncture-resistant, liquid impermeable, flexible film such as a 0.01 to 5 mm thick film, preferably a film having a thickness from 0.05 to 0.5 mm. Suitable films are thermoplastic, thermally bondable films such as polyethylene, vinyl, silicone resins or polyurethane which can be in the form of a closed cell foam. The surface of the pouch has good wetability for water, is resistant to hydrolysis, has flame retardence and resistance to U.V. radiation. It is stable to being agitated with hot soapy water in a washing machine. The film can have a Shore A Hardness from 50 to 100, a Specific Gravity of 1.1 to 1.3, an elongation of at least 300% and a minimum tear strength of 200 Lb/in. The film should have a high melting temperature above 180° C. in order to be capable of surviving temperatures encountered in washing and drying machines. However, hand washing and air drying of the bra are preferred.

The pouches are filled with a mixture of water and a major amount of an organic, hygroscopic material miscible with water. The mixture of water and the hygroscopic material forms a clear, uniform liquid having a viscosity similar to water. The organic hygroscopic materials are polyhydric organic compounds containing a plurality of hydroxyl group such as glycerine (glycerol) or liquid polyols. Glycerine is preferred since it is a clear, colorless, odorless syrupy liquid having hygroscopic properties. A USP grade having minimum purity of 99.5% is preferred.

Analysis of a USP glycerine used in the push-up bra of the invention follows:

| TEST | RESULT | SPECIFICATION |
|---|---|---|
| Glycerine Content % | 99.68 | 99.5 min. |
| Relative Density 25/25 | 1.2609 | 1.2607 min. |
| Color Apha | 5 | 10 max. |
| Ash | <0.01 | 0.01 max. |
| Chloride ppm | <10 | 10 max. |
| Sulphate ppm | <20 | 20 max. |
| Arsenic ppm | <1.5 | 1.5 max. |
| Heavy Metal ppm | <5 | 5 max. |
| Chlorinated Compounds ppm | <30 | 30 max. |
| Fatty Acid & Esters ml 0.5 NAOH | 0.7 | 1.0 max. |

A prototype of the push-up bra of the invention was prepared by filling about one-half of the volume of a polyurethane pouch with a mixture of 30% water and 70% USP glycerine. The tab on the pouch was heat sealed and then inserted into a pocket in a push-up bra. The tab was sewn into the periphery of the pouch and the seam on the inner layer of fabric was closed.

The film used to form the pouch was a closed cell polyurethane having the following properties:

| Properties | |
|---|---|
| Color APHA | 5 |
| Thickness | 0.1 mm |
| Hardness | 87 Shore A |
| Specific Gravity | 1.20 |
| Tensile Strength | 6525 psi |
| Elongation | 480% |
| Tear Strength | 400 lb/in |
| Melting Temperature | 180–190° C. |

The prototype was tested under normal wearing conditions. The mixture of water and glycerine provided a natural cushion. The pouch did not leak or ooze liquid. It was self sealing. There was no loss of volume over a 3 month test period due to permeation of water due to the glycerine humectant within the pouch. The bra was very comfortable for a shaping bra and gave a natural lift for a fuller look. Though the bra can be machine washed, there is less wear and tear if the bra is hand washed and hung to dry.

The hygroscopic liquid containing pouch of the invention can also be incorporated into an uplift bra pad 100 as shown in FIGS. 4–7. The pad 100 has an oval-shaped front panel 102 and an oval shaped rear panel 104. The panels 102, 104 can be formed of woven or non-woven fabrics, preferably a soft woven synthetic fabric such as Nylon (linear polyamide) or polyester. The peripheral edges 106, 108 of the panels 102, 104 are joined, suitably by stitching 110 to form a cavity 118 for receiving a pouch 112 containing a body 114 of hygroscopic liquid.

The panels 102, 104 may have a thin layer 105 of flexible foam usually 1/16 to 1/4 inch thick attached to the inside surface, suitably by adhesive and/or thermal lamination. An optional strip 116 of flexible foam my extend across the upper portion of the cavity 118. The strip 116 is usually from 1/4 to 1/2 inch thick and occupies no more than 45% of the height of a cavity 118 usually about 30–40% of the cavity. The upper edge 120 of the strip 116 can be bound by stitching to the peripheral edges of the pad 100. The strip 116 can taper toward the upper edge 131 of the pad 100 to form a smoothly curved recess for receiving, supporting and covering part of the uplifted breast tissue 141 as shown in FIGS. 6–7.

Another optional feature is to laminate the front panel 102, rear panel 104 and flexible foam strip 116 together by heat or adhesive to form a closed, flat upper portion 124 decreasing the size of the cavity 118 to form a smaller cavity 126. The upper portion 124 is disposed behind the upper portion 128 of the convex front face 128. The rear face 130 of the upper portion of the film 104 is concave. When the pouch 112, containing liquid 114 is inserted into the cavity 118 the lower portion 134 of the front film 102 and the lower portion 136 of the rear film 104 will both have a convex shape.

The pouch 112 has a tab 138 which can be placed between the outer edges of the panels 102, 104 and sewn to anchor the pouch 132 within the smaller cavity 128.

Figure 6:
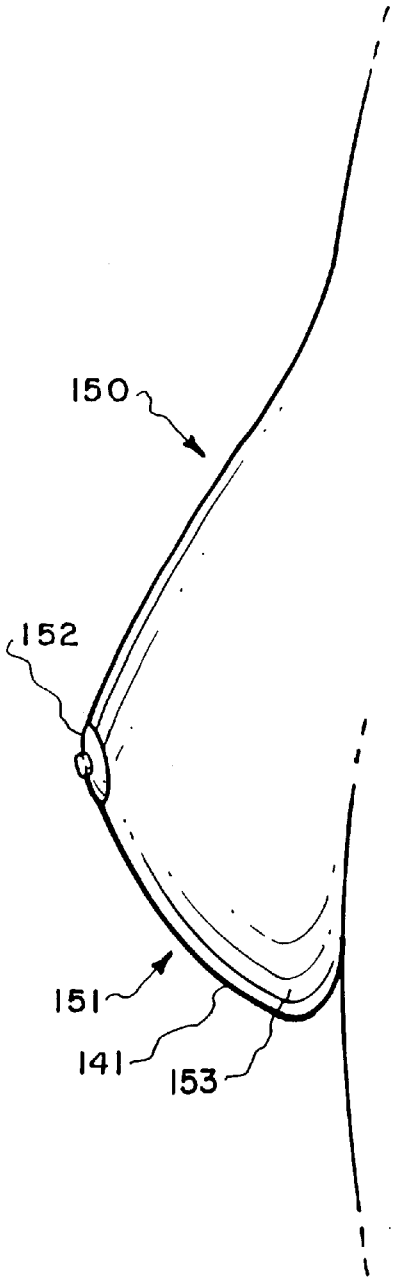
FIG. 6 is a schematic view of an unsupported breast.
Figure 7:
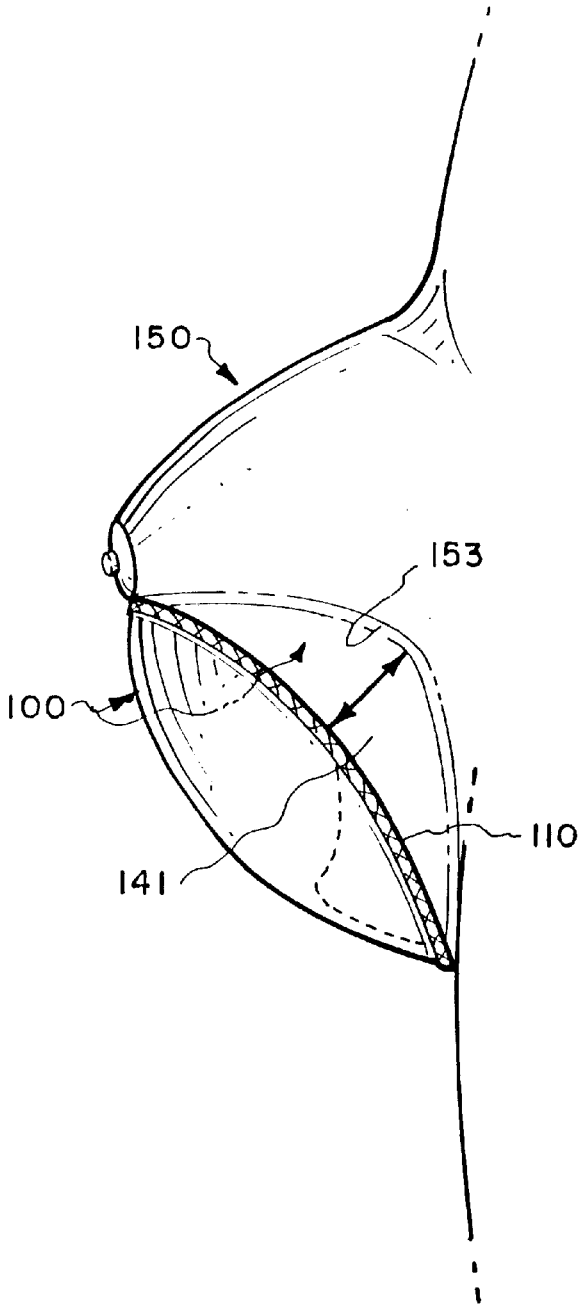
FIG. 7 is a schematic view showing the profile of a breast when the push-up pad is in place.

As shown in FIGS. 6 and 7, the unsupported breast 150 assumes a downward distended configuration 151 below the nipple 152. However, when the pad 100 is placed within a brassiere cup, not shown, the incompressible body of liquid

114 within the pouch 112 will push-up the portion 153 lifting the breast 150 to a higher elevation and more attractive contour.

It is to be realized that only preferred embodiments of the invention have been described and that numerous substitutions, modifications and alterations are permissible without departing from the spirit and scope of the invention as defined in the following claims.

What is claimed is:

1. A push-up pad for placement in a bra cup comprising an oval shaped front fabric panel, an oval shaped rear fabric panel, the edge of said panels being joined to form a pocket, a flexible, sealed envelope formed of two edge-sealed films of tough puncture-resistant synthetic resin received in the pocket and an odorless, organic liquid containing 10 to 60 percent by weight of water being present in the envelope.

2. A pad according to claim 1 in which the envelope is formed of a heat sealable, flexible, tear-resistant film having a thickness from 0.01 to 5 mm.

3. A pad according to claim 2 in which the inner surfaces of the fabric layers contain a layer of cushioning material.

4. A push-up pad according to claim 3 in which the cushioning material is flexible foam.

5. A push-pad according to claim 3 in which the fabric is woven and is selected from polyamide or polyester.

6. A push-up pad for placement in a bra comprising an oval-shaped front fabric panel, and oval-shaped rear fabric panel, said panels being edge-stitched to form a pocket, a flexible, sealed envelope formed after edge-sealed films of tough, puncture-resistant synthetic resin received in the pocket an odorless, organic liquid being present in the envelope, a strip of flexible, thermoplastic foam extending across a top portion of the pocket and said front panel and said rear panel being adhered to the strip to form a flattened, concave upper section.

7. A pushup pad according to claim 6 in which the strip comprises no more than 45% of the height of the pad.

8. A push-up pad according to claim 7 in which the strip comprises no more than 30–40% of the height of the pad.

9. A push-up pad according to claim 6 in which the upper edge of the strip is stitched to the upper edges of the panels.

10. A push-up bra containing:

two bra cups;

means joining the cups;

a strap connecting the cups;

said cups each containing a push-up pad as defined in claim 9.

* * * * *